US009273528B2

(12) United States Patent
Cooper

(10) Patent No.: US 9,273,528 B2
(45) Date of Patent: Mar. 1, 2016

(54) FLEXIBLE SINKER BAR WITH ELECTRICALLY CONDUCTIVE WIRES

(76) Inventor: Larry V. Cooper, Lake Charles, LA (US)

( * ) Notice: Subject to any disclaimer, the term of this patent is extended or adjusted under 35 U.S.C. 154(b) by 840 days.

(21) Appl. No.: 12/086,518

(22) PCT Filed: Dec. 13, 2006

(86) PCT No.: PCT/US2006/047354

§ 371 (c)(1),
(2), (4) Date: Jun. 13, 2008

(87) PCT Pub. No.: WO2007/070507

PCT Pub. Date: Jun. 21, 2007

(65) Prior Publication Data

US 2009/0301709 A1 Dec. 10, 2009

Related U.S. Application Data

(60) Provisional application No. 60/749,607, filed on Dec. 13, 2005.

(51) Int. Cl.
*E21B 23/14* (2006.01)

(52) U.S. Cl.
CPC ..... *E21B 23/14* (2013.01)

(58) Field of Classification Search
CPC ..... E21B 23/14; E21B 23/00
USPC ..... 166/241.5
See application file for complete search history.

(56) References Cited

U.S. PATENT DOCUMENTS

| | | | | |
|---|---|---|---|---|
| 4,616,705 | A * | 10/1986 | Stegemeier et al. | 166/250.01 |
| 4,921,438 | A * | 5/1990 | Godfrey et al. | 439/190 |
| 6,227,292 | B1 * | 5/2001 | Cooper | 166/241.5 |
| 2002/0007952 | A1 * | 1/2002 | Vann | 166/369 |

* cited by examiner

*Primary Examiner* — Brad Harcourt
(74) *Attorney, Agent, or Firm* — William H. Holt

(57) ABSTRACT

An assembly including a flexible sinker bar (24) including an electrically conductive wire (30) for use in the well drilling industry, particularly oil wells, and more particularly for use in assisting introduction into the wellbore, through the drill pipe or tubing, various types of logging tools and other completion assemblies securable to a tool connector (T), such as chemical cutters, string shots, free point indicators, jet cutters, metal severing tools, split shot cutters, radial cutting torches, pipe recovery logs, temperature logs, noise logs, and perforating guns. Conductive wire 30 is used to send electric power to operate or trigger the various logging tools.

4 Claims, 2 Drawing Sheets

FLEXIBLE SINKER BAR WITH ELECTRICALLY CONDUCTIVE WIRES

Priority is claimed from U.S. Provisional Application Ser. No. 60/749,607, Dec. 13, 2005.

BACKGROUND OF THE INVENTION

The invention relates to the well drilling industry, particularly oil wells, and more particularly to apparatus for assisting introduction into the wellbore, through the drill pipe or tubing, of logging tools and other completion assemblies, such as chemical cutters, string shots, free point indicators, jet cutters, metal severing tools, split shot cutters, radial cutting torches, pipe recovery logs, temperature logs, noise logs, and perforating guns.

Modern drilling techniques make it possible to drill "extended reach" and "horizontal" wells to exploit fractured formations and to access isolated productive zones away from the vertical wells of a single drilling platform. In wells deviated beyond 60 degrees, special hardware is required to guide, push, or pump the logging tools or completion assembly toward the interval of line that is of interest. During use of a conventional, rigid, sinker bar, the logging tools or other completion assemblies must be forced to pass through the angle of deviation thereby causing problems related to the rigidity and length of the rigid sinker bar assembly.

SUMMARY OF THE INVENTION

A flexible, wire rope, sinker bar similar to that disclosed in my earlier U.S. Pat. No. 6,227,292, granted on May 1, 2001, is modified to provide insulated, electrically conductive wire, or wires, extending along the length of the flexible sinker bar either along the helical periphery of my patented wire rope sinker bar, or within the windings thereof or as the core wire of the helical wound, wire rope.

The electrically conductive wire, or wires, facilitates the application of voltage and current to any of various types of logging tools of the type alluded to above, as well as facilitating transfer of data between logging tools and surface equipment, and various completion devices being assisted into the wellbore.

Other applications for the present invention include salvage operations of damaged wells, particularly for off-shore platforms having bent pipe that has been damaged by storms, such as hurricanes and tornadoes, or collisions by ships, and the like. The flexible wire rope sinker bar is useful for pushing cutters and other devices past the damaged or bent areas in the pipe thereby providing a huge economic benefit through salvage and reclamation of non-operating, or under-performing wells.

Additionally, the present invention is useful for other applications including, but not limited to, minimizing gas cap or coning effects, and is useful for assisting in production of heavy oil reserves.

The invention is also useful in the field of seismic technology for maintaining spacing between adjacent seismic sensors and other instrumentation when used in combination with explosive charges for detecting the presence, or absence, of hydrocarbon deposits of oil or gas.

DESCRIPTION OF THE PREFERRED EMBODIMENTS

Figure 1:
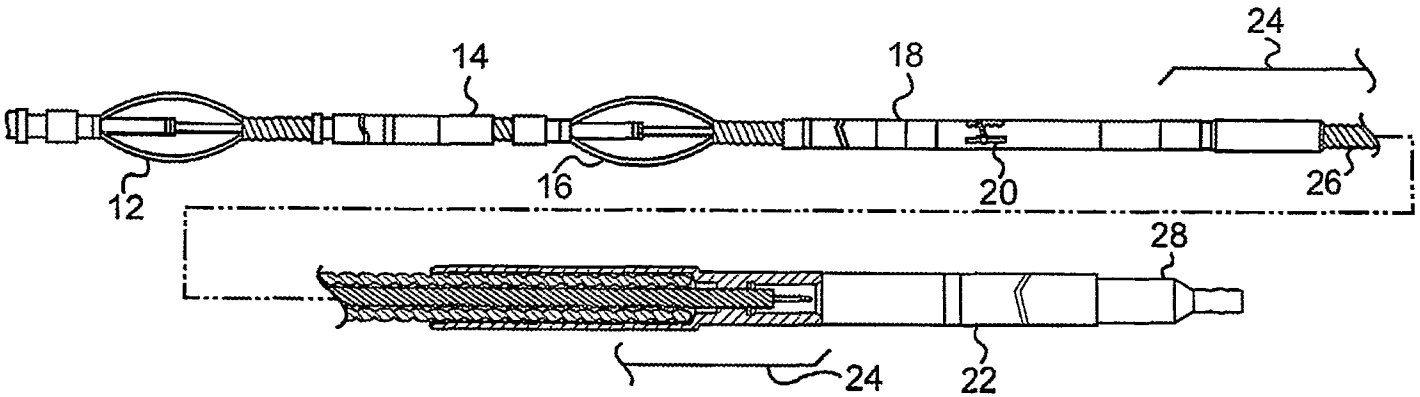
FIG. 1 shows an assembly of apparatus for use in wellbore operations including a crimped, flexible wire rope, sinker bar in accord with the present invention.

FIG. 1 shows an assembly of apparatus, generally indicated by the numeral 10, having a series of parts including a lower bow spring assemble 12, a stress detector 14, an upper bow spring assembly 16, an oscillator 18, a slip joint 20, and a collar locator 22, which parts are known in the industry. Located between the slip joint 20 and the collar locator 22 is a flexible sinker bar, generally indicated by the numeral 24, which includes a length of wire rope 26 that terminates at collar locator 22. A cable head 28 extends forward of the collar locator 22.

Figure 2:
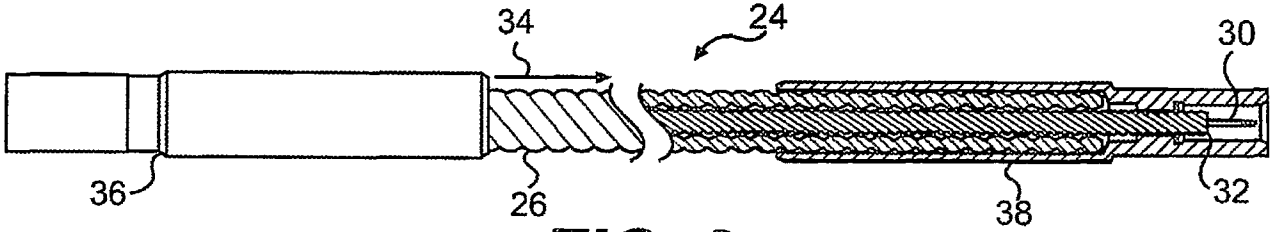
FIG. 2 shows details of the flexible sinker bar portion of the assembly of FIG. 1

Flexible sinker bar 24, as shown in more detail in FIG. 2, comprises a flexible sinker bar formed of wire rope or strand 26 of the type particularly described in my earlier U.S. Pat. No. 6,227,292 filed on Oct. 21, 1999 and granted on May 8, 2001. The present invention provides an improved sinker bar wherein the improvement includes an electrically conductive wire, or wires, 30, preferably including insulation 32, and running the length of wire rope 26. Electric wire 30 is useful for triggering a plethora of operations, as set out above, by locating appropriate tools at location T adjacent the end of sinker bar 24.

Electrical wire, or wires, 30 are shown in FIG. 2 as comprising the core of the helically wound rope 26. It is to be understood that such wire or wires may, alternatively, be secured to the outside of the wire rope 26 as shown at 34 in FIG. 2, and may even be wrapped in helical fashion (not shown) along the wire rope 26. In such positions, it will be understood that the conductive wire may need to be provided with a wear resistant cover or coating to protect the wire against undue wear.

Figure 3:
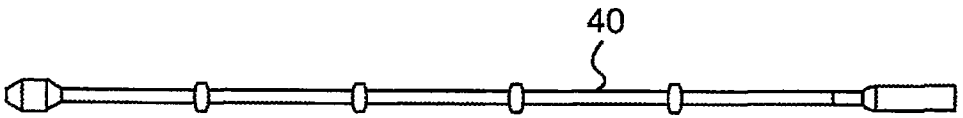
FIG. 3 illustrates a typical primer cord usable with the assembly of FIG. 1.

FIG. 3 shows a primer cord 40 as an example of one tool that can be triggered by the electrically conductive wire 30 at tool connector T.

Figure 4:
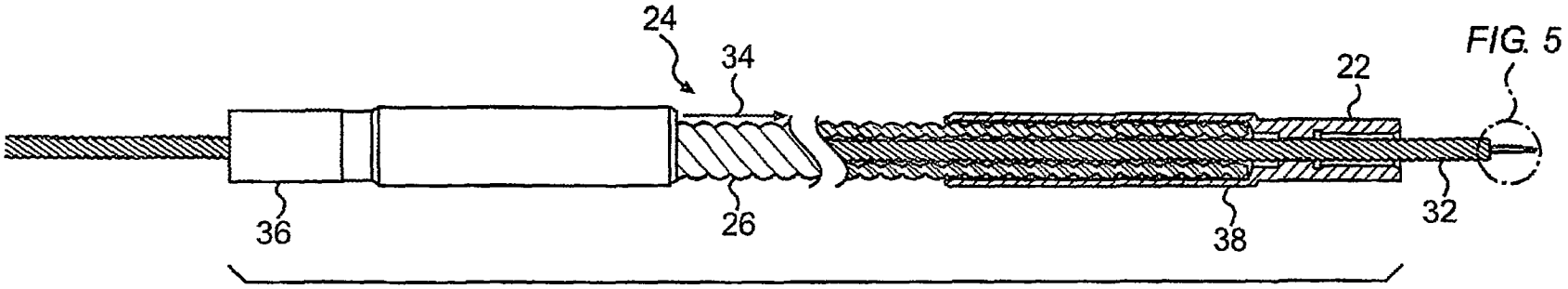
FIG. 4 shows enlarged details of the flexible wire rope sinker bar and electrical wire(s) extending therethrough.

As is illustrated in FIG. 4, it is presently contemplated that a typical flexible sinker bar 24, in accordance with the invention, will have a length L, on the order of 26+/− feet in length including clamp members 36 and 38 used for securing the ends of wire rope 26. The weight of the illustrated sinker bar is on the order of 86 or more pounds. The length of the electrical wire, or cable, 30 will be in excess of the length of the sinker bar 24 to provide for attachment to tools to be located at a tool connector, generally indicated at T, in FIG. 1.

Figure 5:
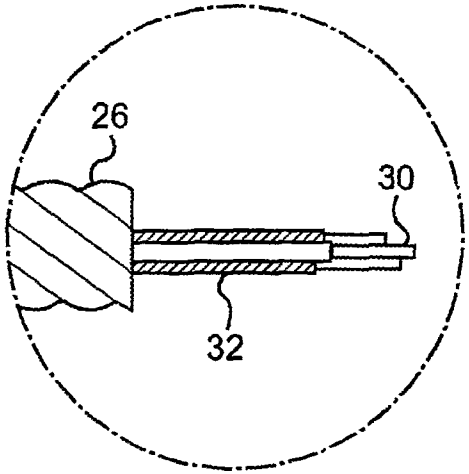
FIG. 5 is an enlarged partial view of a portion of FIG. 4.

As is shown in the partial view of FIG. 5, wire 30 extends from wire rope 26 and includes a covering of insulation 32.

When the flexible sinker bar 24 is used with seismic explorations, the flexible wire rope 26 may have lengths of 50 feet or more for maintaining separation between instruments. Heretofore, problems have occurred because of "overrun" of the connecting wire, and this will not occur when using the present invention.

Inherent in the invention is a method of repairing and/or reclaiming damaged wells by forcing the hefty flexible sinker bar 24 along the interior length of the wellbore to physically repair kinks, bends and the like and, when necessary, introduce various tools, as mentioned above, into the wellbore to perform various processes to restore the well to operation.

Other uses will become apparent to those persons of ordinary skill in the relate art.

From the foregoing description, it will be apparent to those skilled in the art that the various forms of the invention provide many advantages over the known types of sinker bars. While specific showings and descriptions are provided, it is to be understood that differences in size, weight, length, diameters, etc. can be made without departing from the spirit and scope of the invention as defined in the appended claimed subject matter.

I claim:

1. A flexible sinker bar assembly for use in operations with a wellbore, said assembly including a flexible connector member, said flexible connector member comprising a heavy metal wire rope, said wire rope comprising a strand of helically wound wires, characterized in having an electrically conductive wire encased in electrical insulation extending along the length of said flexible connector member, and wherein said electrically conductive wire comprises an axial core of said strand of helically wound wires.

2. A flexible sinker bar assembly as defined in claim 1 wherein said electrically conductive wire provides means for connecting with tools selected from the group consisting of chemical cutters, string shots, free point indicators, jet cutters, metal severing tools, split shot cutters, radial cutting torches, pipe recovery logs, noise logs, and perforating guns.

3. A flexible sinker bar assembly for use in operations with a wellbore, said assembly including a flexible connector member, characterized in having an insulated electrically conductive wire extending along the length thereof, said flexible connector member comprising a heavy metal wire rope, wherein said wire rope comprises a strand of helically wound wires, and wherein said electrically conductive wire comprises an axial core of said strand of helically wound wires.

4. A flexible sinker bar assembly as defined in claim 1 wherein said conductive wire provides means for connecting with tools selected from the group consisting of chemical cutters, string shots free point indicators, jet cutters, metal severing tools, split shot cutters, radial cutting torches, pipe recovery logs, temperature logs, noise logs and perforating guns.

* * * * *